US005664391A

United States Patent [19]

Bartholomew

[11] Patent Number: 5,664,391

[45] Date of Patent: Sep. 9, 1997

[54] ROOF ANCHOR AND HANGING SCAFFOLD SYSTEM

[75] Inventor: Paul F. Bartholomew, Raleigh, N.C.

[73] Assignee: PFB Company, Raleigh, N.C.

[21] Appl. No.: 625,845

[22] Filed: Apr. 1, 1996

[51] Int. Cl.[6] ..... E04F 19/00; A62B 35/00

[52] U.S. Cl. ..... 52/714; 248/237; 182/45; 182/150; 182/3; 403/237; 52/698

[58] Field of Search ..... 52/714, 698; 182/45, 182/3, 82, 150; 403/233, 234, 237; 248/228.3, 237

[56] References Cited

U.S. PATENT DOCUMENTS

| | | | |
|---|---|---|---|
| 2,308,142 | 1/1943 | Alloway . | |
| 3,767,010 | 10/1973 | Newlan et al. . | |
| 4,074,792 | 2/1978 | Zaugg et al. | 182/150 |
| 4,122,916 | 10/1978 | Strobel . | |
| 4,226,058 | 10/1980 | Riley . | |
| 4,256,201 | 3/1981 | Neighbors . | |
| 4,828,073 | 5/1989 | Friday | 182/45 X |
| 4,957,185 | 9/1990 | Courchesne et al. | 182/82 X |
| 4,971,169 | 11/1990 | Furth . | |
| 5,143,171 | 9/1992 | Glynn et al. | 182/45 X |
| 5,248,021 | 9/1993 | Nichols | 182/3 |
| 5,282,597 | 2/1994 | Babcock | 248/237 |
| 5,307,897 | 5/1994 | Turner et al. . | |
| 5,353,891 | 10/1994 | Griek et al. . | |
| 5,379,859 | 1/1995 | Pigman . | |

FOREIGN PATENT DOCUMENTS

| | | | |
|---|---|---|---|
| 2208889 | 4/1989 | United Kingdom | 182/45 |

*Primary Examiner*—Wynn E. Wood
*Assistant Examiner*—Timothy B. Kang
*Attorney, Agent, or Firm*—Jones & Volentine, LLP

[57] ABSTRACT

A J-hook roof anchoring and securement assembly, which is easily set-up and taken down, includes a rope tie-off attachment point. The J-hook securement assembly also includes a hanging scaffold attachment apparatus to provide an attachment point for a hanging scaffold system. The hanging scaffold system includes a vertical support post attached to platform base and having walk boards provided thereon. A vertical safety rail post contains angled brackets that mate with top and bottom portions of the walk boards. A securing rod is attached at one end to the safety rail post, is threaded through the walk boards, and is secured at a second end. The walk boards are held in clamping contact with the vertical support post by the use of the securing rod.

22 Claims, 8 Drawing Sheets

ROOF ANCHOR AND HANGING SCAFFOLD SYSTEM

DESCRIPTION

BACKGROUND OF THE INVENTION

1. Field of the Invention

The present invention generally relates to roof anchor and hanging scaffold systems, and more particularly, to a system that produces a working platform hanging off the eave of a sloping roof system that is reusable, easy to deploy, and which can be quickly taken down.

2. Description of the Related Art

Worker safety is of great concern not only to construction industry employers and employees, but to federal and state governments as well, and is the subject of extensive regulation. The Occupational Safety and Health Administration (OSHA) is tasked with drafting, inspecting, and enforcing work place safety and health regulations. Notably, OSHA's construction standards number some 400 densely written pages. Brad German and Rick Schwolsky, "Better Safe Than Sorry", *Builder*, Vol. 18, No. 1, page 344 et seq., January 1995. See generally 29 C.F.R. 1910, which is the complete set of OSHA standards.

The need for the number and scope of such regulations is clear—construction workers face numerous and serious dangers at the job-site. OSHA's "Big Four" safety concerns include fail protection, electrical grounding, struck-by protection, and excavation safety. The greatest number of serious injuries are due to falls, either from the roof or the side of the structure during construction. Philip C. Sunstrom, "Become the Company's OSHA Oracle", *American Society for Industrial Security*, Vol. 38, No. 3, pg 24 et seq.

Various scaffolding and safety systems have been proposed. Some are engineered from the ground up while others are deployed so as to hang off the roof or wall structure. All of these scaffold systems, however, suffer from a common defect—the enormous amount of time to assemble, erect, reposition, and take down such systems.

For the average commercial construction project, it takes approximately 4.5 man days (i.e., three workers for a day and a half) to set up a two-story, 100 foot long scaffold system and approximately three man days take it down. This results in a double cost; one related to the actual labor costs associated with the scaffold assembly/disassembly process, and the other a productivity loss since work on the main project is delayed by the time necessary to erect the scaffold. This double cost leads to partial or non-compliance with OSHA regulations, jeopardizing worker safety.

Hanging scaffolds, that is, scaffold systems that are affixed to the roof and hang over the cave to support a working platform, have been proposed to reduce the amount of labor and time necessary for scaffold assembly/disassembly. While saving some time, these hanging scaffolds are not without their own shortcomings.

For example, the roof anchoring point of the hanging scaffold system is critical as it must withstand thousands of pounds of force in several directions while the construction work is in progress. Typically, the roof anchor is thus nailed, bolted or fixedly attached in some other way to the roof to provide the necessary safety margin. However, this results in a roof anchoring system that requires additional time and effort to remove and reposition, thereby reducing the time savings associated with the hanging scaffold system.

Furthermore, many hanging scaffold systems are theoretically designed for easy pre-assembly prior to deployment, again with the objective of reducing labor costs and cutting productivity losses. Most of these hanging scaffold systems, however, are not as stable as ground based scaffold systems.

Accordingly, a need exists for a versatile, stable and safe roof anchoring and hanging scaffold system that is easy to erect, reposition and take down.

SUMMARY OF THE INVENTION

Accordingly, the present invention is directed to a roof anchor and hanging scaffolding system which substantially obviates or overcomes one or more limitations of the prior art. The invention provides several features which greatly enhance the stability and ease of use of a construction site scaffold and safety system.

To achieve these and other advantages and in accordance with the purpose of the invention, as embodied and broadly described, the invention interacts with a roof having a truss structure composed of spaced apart joists running perpendicular to a roof edge and a sheet overlay on top of the joists defining small gaps between courses of sheets forming the overlay, the invention being a roof tie-off anchoring system, comprising a base support member contacting the overlay and having first and second ends; a joist securement assembly pivotally connected about a horizontal axis to the first end of the base support member for lockingly engaging and disengaging the securement assembly through the small gaps to a respective underlying joist, the securement assembly comprising a J-hook having a main body portion, a bottom portion and a upstanding tip portion, the bottom portion in locking engagement with an underside of the joist and the main body portion and the upstanding tip portion in contact with respective sides of the joist, thereby providing three-sided engagement of the J-hook to the joist; and a means for attaching a rope or cable extending from the second end of the base support member to provide a tie-off attachment point.

In another aspect the invention utilizes the securement assembly described above with the addition of a means for attaching a hanging scaffold system. The means for attaching includes a receiving plate having steel studs extending therefrom. The hanging scaffold system contains a female member having stud holes provided at one end so as to mate with the respective studs of the receiving plate.

An adjustable elbow joint is provided at the second end of the female member, the elbow joint having a first pivoting connection aligned with a first aperture on a first vertical support post and second adjustable connection aligned with a second aperture on said first vertical support post.

The hanging scaffold and anchoring system further includes a platform base connected to said first vertical support post and a vertical safety rail post parallel to and spaced apart from the first vertical support post. The safety rail post has two spaced apart L-shaped angled brackets affixed to its bottom portion. A plurality of walk boards are in contact with the base platform and reside between the L-shaped angle brackets on the vertical safety rail post.

The invention includes a means for securing the walk boards in clamping contact with the first vertical support post, the means for securing comprising a rod attached at one end to the vertical safety rail post, the rod being threaded through the walk boards, and securely held at the other end using a washer and carter pin.

In still another aspect, a ladder may be incorporated into the hanging scaffold system using a second vertical support post spaced apart and parallel to said first vertical support post. The first and second vertical support posts have horizontal and angled brackets therebetween, defining a ladder or support surface for additional walk boards.

BRIEF DESCRIPTION OF THE DRAWINGS

The foregoing and other objects, aspects, and advantages will be better understood from the following detailed description of the embodiments of the invention with reference to the drawings, in which.

DETAILED DESCRIPTION OF THE INVENTION

Figure 1B:
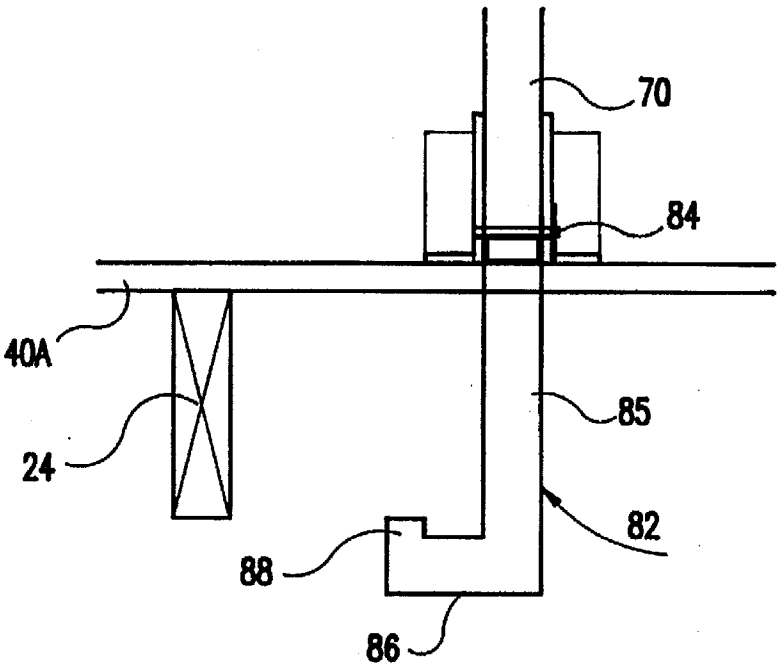
FIGS. 1A–1D are enlarged views showing the successive steps for lockingly engaging the J-hook member to a roof joist.

The invention is directed to a roof anchor and hanging scaffold system that provides several unique features—both individually and in combination—which enhance the stability and safety of a construction site scaffold and safety rail system as well as reduce the time and costs needed to assemble and disassemble such a system.

An innovative J-hook roof anchoring and safety rail system was discussed and described in U.S. patent application Ser. No. 08/562,654, to Paul F. Bartholomew, entitled "Safety Rail System for Use During Construction or Maintenance Repair of Pitched Roofs", filed Nov. 27, 1995 (Attorney Docket No. PFB-1), the entire contents of which are incorporated herein by reference. Certain portions of the pending application are set forth where appropriate for ease of reference and discussion.

The present invention provides additional improvements or embodiments incorporating the J-hook roof anchoring design described in application Ser. No. 08/562,654, including the use of the J-hook with a rope anchor, with a hanging scaffold system, or a combination rope anchor and hanging scaffold system.

Reference will first be made to FIGS. 1A–1D illustrating the basic J-hook securement assembly as described in the application Ser. No. 08/562,654, designated generally as reference numeral 80, and the sequence of steps to lockingly engage the J-hook to the roof joist.

Figure 1A:
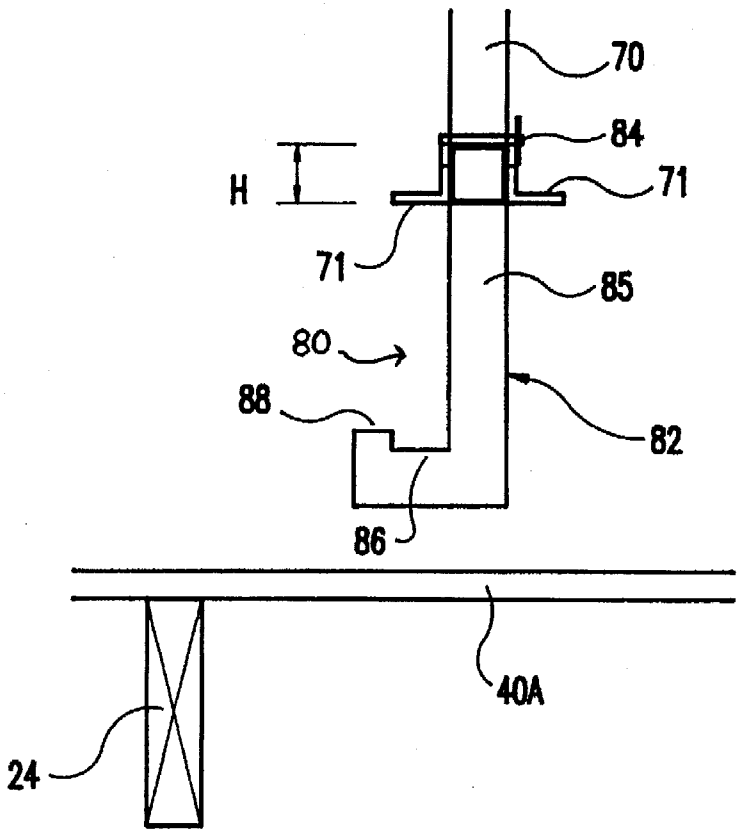

FIG. 1A depicts an end view of a course 40A of roofing plywood or equivalent roofing material and roof joist 24. Only one roof joist 24 is illustrated for simplicity, it being understood that roof joist 24 is one of a series of parallel spaced roof joists that run generally perpendicular to a roof edge to form a truss structure for a pitched or flat roof.

In the present invention, the securement assembly 80 provides a secure, detachable means for anchoring a rope tie-off system, hanging scaffold system, or both. The securement assembly 80 comprises a thin, flat J-hook 82 that is pivotally connected to side support 71 by a hinge 84 that is located at a height H above the lower surface of the side support 71. J-hook 82 includes a top portion, a main body portion 85, a bottom portion 86 and an upstanding tip portion 88, with the entire J-hook preferably being integrally formed of a single sheet of metal having a thickness that permits it to be inserted and removed through the standard ⅛" gap between courses of plywood overlay.

Referring now to FIGS. 1A–1D, the procedure for installing the J-hook will now be described. In the first step, side support 71, which is connected to extension member 70, is raised as shown in FIG. 1A so that J-hook 82 is substantially vertical to course 40A. As shown in FIG. 1B, in this orientation, and with J-hook 82 positioned just above the upper edge of course 40A and slightly offset from joist 24, J-hook 82 is then lowered so that the upstanding tip 88 is positioned at a level just below the bottom of joist 24 when hinge 84 rests on top of course 40A.

Figure 1D:
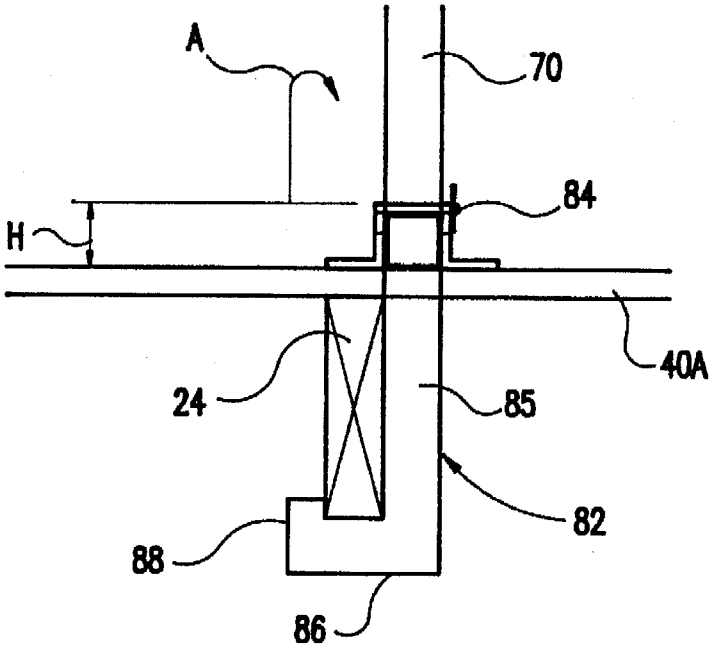
Figure 1C:
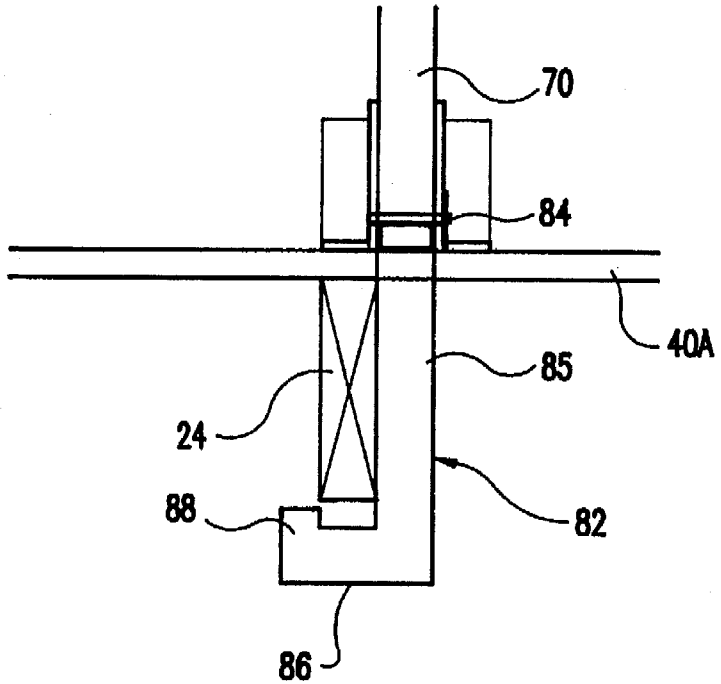

Next, referring to FIG. 1C, the J-hook 82 is shifted laterally to place the 1-hook bottom portion 86 directly under joist 24. The side support 71 is then lowered by pivoting the extension member 70 (see arrow A in FIG. 1D) to bring the entire side support 71 into contact with the plywood course 40A directly above joist 24. Lowering the side support 71 serves to raise hinge 84 to a level above the plywood and thereby raise J-hook bottom portion 86 so as to contact the bottom of joist 24, while permitting J-hook tip 88 and main body portion 85 to engage the respective sides of the joist 24 as shown in FIG. 1D. This causes the J-hook to lockingly engage the joist 24 on three sides for a secure hold, preventing disengagement due to lateral forces.

The J-hook can be easily removed by reversing the above steps and sliding the hook out. It is understood that the J-hook may be used with any size joist (e.g., 2×4, 2×6, 2×8 etc.) by using J-hooks of different lengths. For example, in a typical roof system having 2×6 joists and a ⅝" thick plywood overlay, the dimensions of the Y-hook are ⅛" thick, 9" long, 3½" wide at the base, with the interior pocket between tip 88 and main body portion 85 being 1⁹⁄₁₆".

Figure 2A:
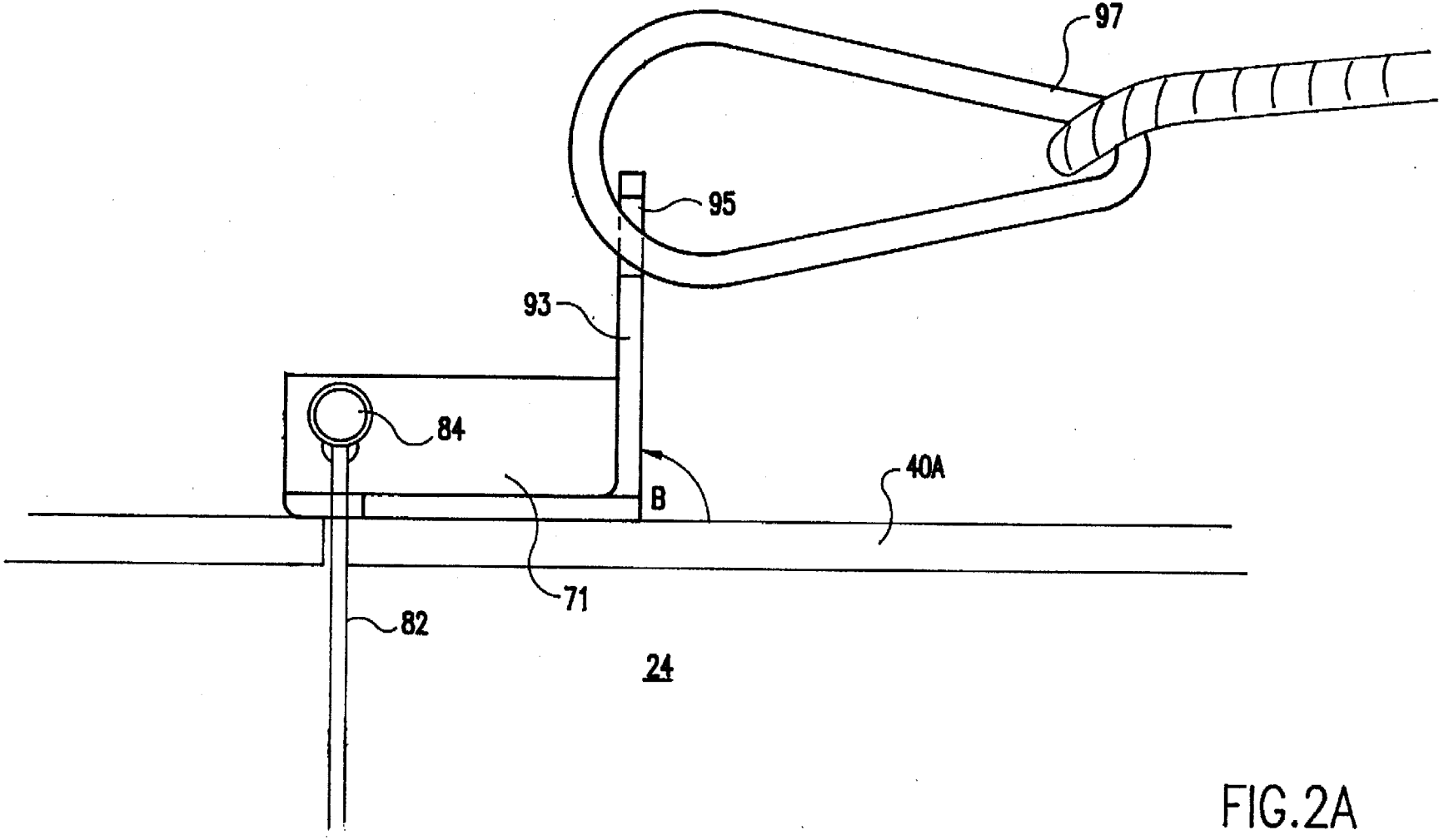
FIG. 2A illustrates a side view of the rope anchor attachment and J-hook assembly of the present invention.

Referring now to FIG. 2A, the rope anchor attachment for the J-hook will now be described. For any type of roof work without a safety rail, OSHA requires that workers be secured by a rope or cable attached to a suitable support. In these tie-off systems the worker usually wears a belt or harness that is connected to the roof rope anchor.

FIG. 2A illustrates the side support 71, J-hook 82, hinge 84, and joist 24 as described previously. There is also provided a means for attaching 93 a rope or cable to enable a tie-off system. The means for attaching 93 in FIG. 2A takes the form of a substantially vertical member having a hole 95 provided therein to allow a rope or cable system 97 to pass therethrough. As shown, the means for attaching 93 is approximately 3–5" long, but may be more or less as desired.

It is understood that the means for attaching 93 need not be oriented at a substantially vertical angle. In fact, the means for attaching need only be oriented at an angle B that is displaced from the plywood overlay 40A a sufficient distance so as to provide enough space for the rope or cable system 97 to be passed through hole 95.

The preferred embodiment, however, would be a substantially vertical means for attaching 93 as shown in FIG. 2A. Under tension, the height of the rope attachment point causes the bottom portion of the J-hook to be pulled up at an angle into the joist 24, providing added holding power to withstand a 5000 lb. pullout as specified by OSHA safety line regulations.

Figure 2B:
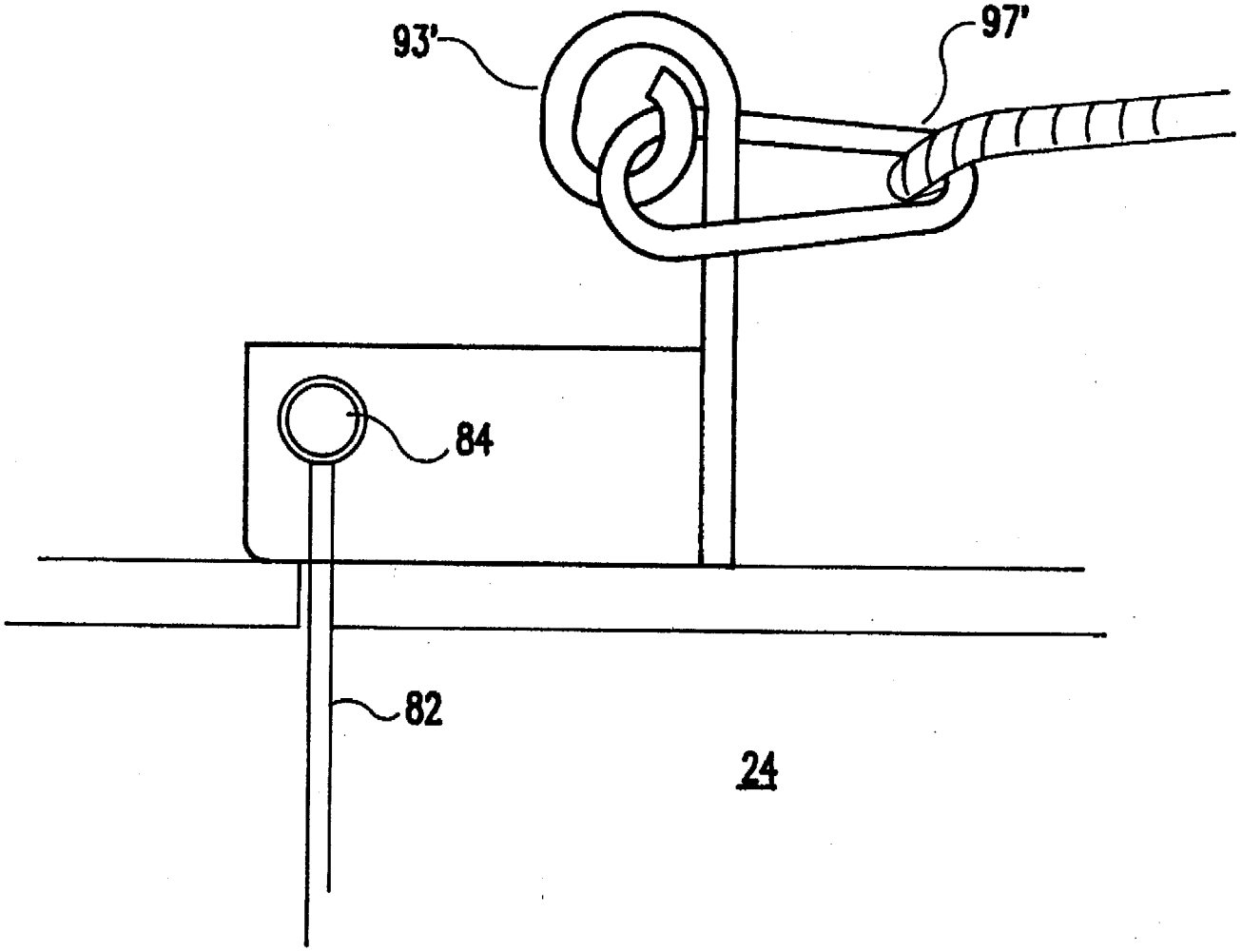
FIG. 2B illustrates a side view of an alternate embodiment of the rope anchor attachment and J-hook assembly of the present invention.

Other equivalent means for attaching may be used with the J-hook assembly. For example, a non-continuous loop 93' made of a suitably strong material such as flat or tubular steel may be used to detachably engage one end of a rope or cable. As shown in FIG. 2B, a loop of rope or cable, or a loop-shaped device attached to the rope or cable 97', is merely passed over the curved attaching means 93' to provide a secure attachment point. The curved nature of the attaching means 93' prevents the rope or cable system 97' from disengaging under tension.

The side support 71 may be manufactured of materials having suitable strength characteristics, for example, ¼" strap steel bent to an L-shaped configuration. The means for securing 93 may be made of a similar material and either formed integrally with, or separately affixed, to the side support 71.

The rope anchor and tie-off system of the present invention provides some unique advantages. One is that the present embodiment provides an attachment point that can withstand several thousand pounds of force in several directions as required by OSHA regulations.

Also, where there are several roofing workers walking around laying shingles, conventional tie-off systems may become more of a hazard than a safety measure. Another advantage of the present embodiment is the ease of inserting and removing the J-hook attachment point, allowing workers to easily adjust the location of the J-hook to reduce interference with other workers. With this invention, workers are much more likely to adjust the location, and thereby increase safety, since the time involved is minimal.

Figure 3:
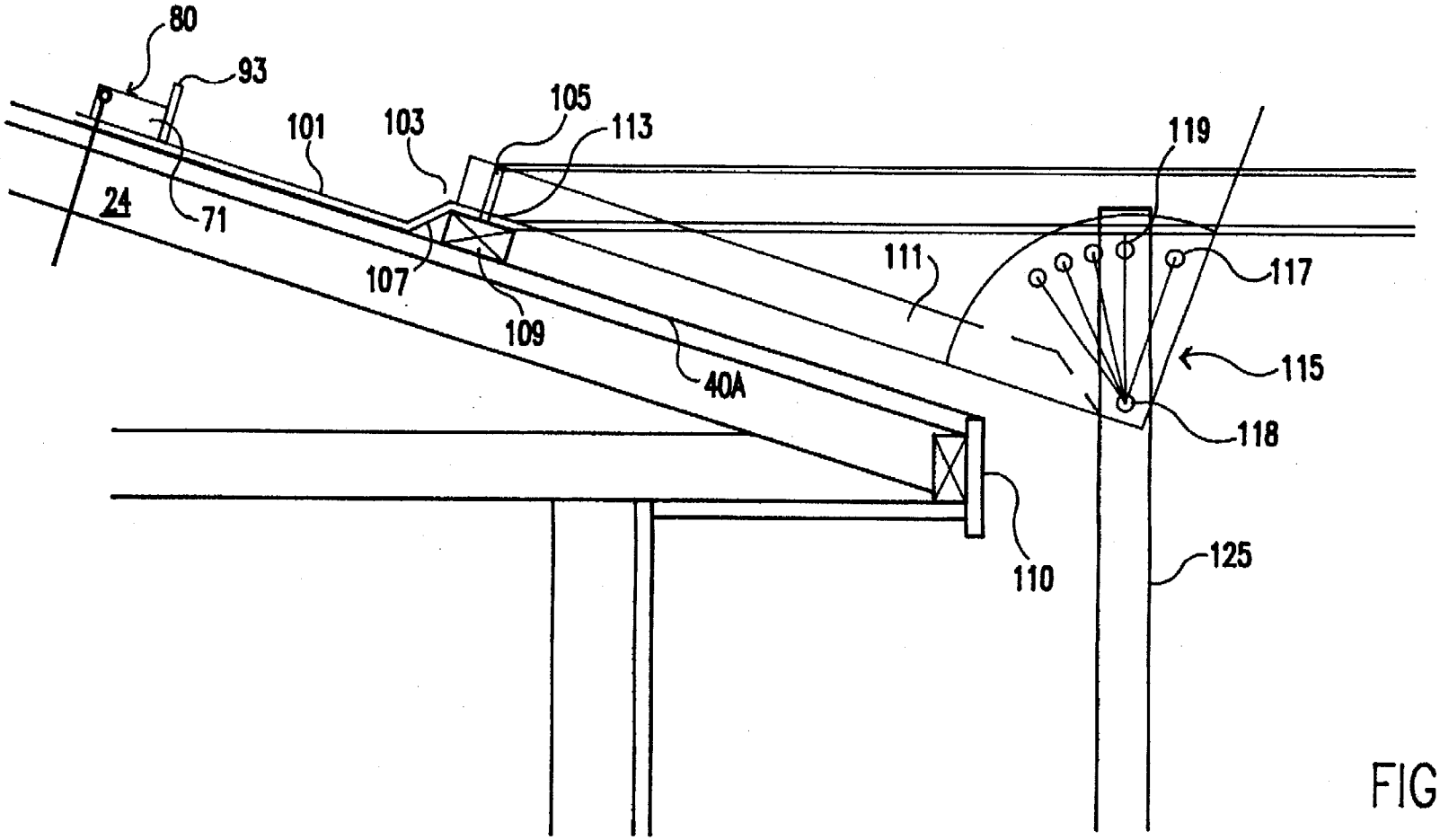
FIG. 3 illustrates a side view of the hanging scaffold attachment and J-hook assembly of the present invention.

In another embodiment, the J-hook anchoring system may be modified to provide an attachment point for a hanging scaffold system. With reference to FIG. 3, there is shown the J-hook securement assembly 80 as described previously. The means for attaching the hanging scaffold comprises a flat, elongated attachment strap 101 fixed to one end of the side support 71. The attachment strap 101 may be made of a material of suitable strength, for example, ¼"×1½" strap steel, and either formed integrally with, or separately affixed, to the end of the side support 71. The attachment strap 101 is approximately 18" in length as depicted, but may be made shorter or longer as desired.

The means for securing 93 the rope or cable and elongated attachment strap 101 may be integrated into a single roof anchoring device as shown in FIG. 3, or the they may be separately provided.

At the other end of the attachment strap 101 there is provided a steel receiving plate 103 having steel studs 105 extending therefrom to mate with the female member 111 of the hanging scaffold system discussed further below. While only one stud 105 need be provided, the use of two studs enhances stability and provides a more rigid connection.

As shown in FIG. 3, the steel receiving plate 103 contains an angled portion 107 which is then supported, for example by a small length of 2×4 109, to ensure that female member 111 is raised above the roof surface 40A. This allows a worker to work on the fascia board area 110 without interfering with the hanging scaffold apparatus. It is understood, however, that angled portion 107 and board 109 need not be employed, thereby allowing the steel receiving plate 103 to lie directly on the roof plywood, although at the expense of easy workability on the fascia board area 110.

Stud holes 113 are provided at one end of the female portion 111 that mate with the studs 105 of the steel receiving plate 103. At the other end of the female member 111 is an adjustable elbow joint 115. The elbow joint 115 is connected to vertical support post 125 at connection point 118. The elbow joint also contains a plurality of apertures 117 at various angular positions that may be selected, depending on the slope of the roof, to ensure the working platform (discussed later in the specification) hangs off the eave of the roof at the proper angle. Vertical support post 125 contains a recess 119 that may be selectively aligned with one of the aperture positions 117, with the connection angle being fixed by a small rod or pin inserted therein. The aperture positions 117 shown in FIG. 3 are measured from vertical where 0 degrees represents a right angle formed by the female member 111 and the vertical post 125.

The invention is not limited to the specific number, namely five, or the specific angle positions, namely 0°/18°/30°/40°/50°, as shown in FIG. 3. It is understood that any number of angled positions and any degree of angle are contemplated within the practice of this invention.

Figure 4:
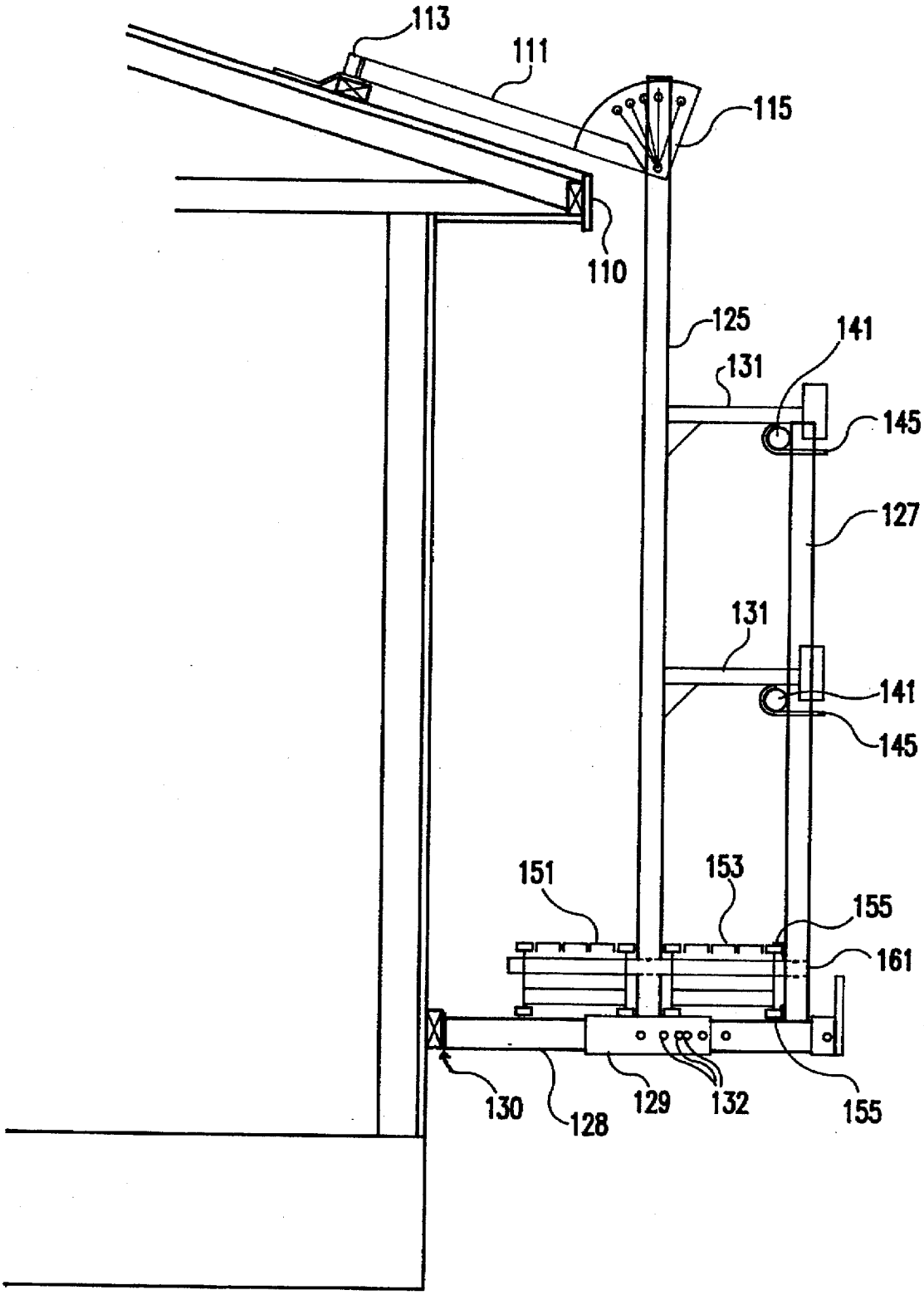
FIG. 4 illustrates a side view of the overall hanging scaffold system of the present invention.

As shown in FIG. 4, a working scaffold platform is connected to the adjustable elbow joint 115 and is comprised of vertical support post 125 connected to platform base 129, forming an inverted-"T" configuration, and vertical safety rail post 127. The vertical support post 125 may be manufactured of 2" tube steel or other equivalent material; the vertical safety rail post 127 may be manufactured of 2" tube aluminum or other equivalent material; and the platform base 129 is made of 2.5" tube steel or other equivalent material.

An inner sleeve 128 slides within platform base 129. The inner sleeve may be made of 2" tube steel, or other material of suitable strength and size so as to slidably fit within the platform base 129. The location of the platform base 129 may be selectively positioned in a lateral direction along the inner sleeve 128 by pin connections 132 so as to ensure a proper level platform surface. The end portion 130 of the inner sleeve 128 abuts the structure to provide stability.

Optional horizontal braces 131 extend off the vertical support post 125 post. As discussed in an alternate embodiment later in the specification, these horizontal braces may be used as ladder rungs or supports for walk boards at different levels.

The vertical safety rail post 127 is secured to walk boards 151 and 153 provided at the base of the hanging scaffold. One side of each walk board rests on the platform base 129 with the walk boards being squeezed together around vertical support post 125 to provide clamping contact. This clamping contact is accomplished by the use of a one inch aluminum rod 161 attached to the vertical safety rail post 127 at one end, and a washer and carter pin arrangement at the other.

Figure 5:
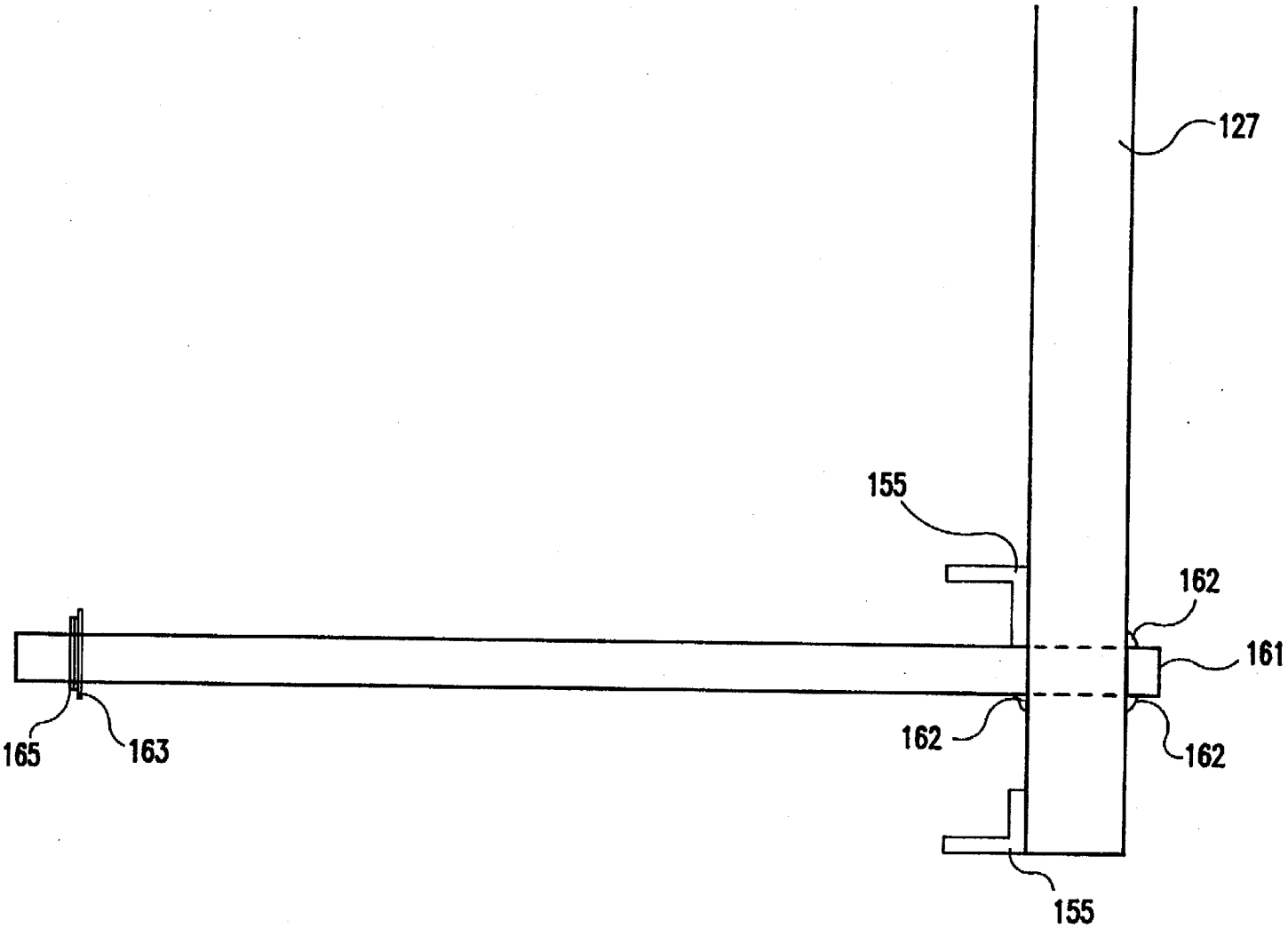
FIG. 5 illustrates an enlarged side view of the base portion of the hanging scaffold safety rail system of the present invention.

Specifically, each of the safety rail posts 127 would have a one inch aluminum rod 161 (see FIGS. 4 and 5) welded at a location between the two angled brackets 155. As shown in FIG. 5, the one inch rod 161 may extend through the vertical safety post 127 with welds 162 on either side. A less secure but still viable alternative is to have the rod 161 abut the vertical post 127 with a single weld at its inner end.

During assembly, the rod 161 is passed through the ladder rung supports of the two walk boards 151, 153 and secured by a washer 163 and carter pin 165. Other equivalent securing means are contemplated. For example, the end portion of the rod 161 may be threaded and then secured by a washer and nut. Regardless of the securing means used, the rigidity of the working platform is thus further enhanced using the rod 161 to provide a lock-in or clamping arrangement with the vertical support post 125 and the walk boards 151, 153.

The walk boards fit between the L-shaped angled brackets 155 (shown in greater detail in FIG. 5) which serve to further fix the walk boards in place as well as keep the vertical safety rail post 127 from twisting about its own vertical axis or from being displaced in any direction from the vertical axis. The angled brackets 155 may be welded or bolted to the vertical safety rail post 127 and are made of aluminum or other equivalent material. The interaction of the angled brackets 155 attached to the vertical safety rail post 127 and the walk boards 151, 153 provides additional rigidity in several directions thereby preventing the scaffold system from bending or swaying when subjected to uneven load conditions.

The walk boards 151, 153 may be of any conventional design but are preferably of two man design measuring 6"×12"×24' and are placed side by side and two inches apart. With a twenty-four (24) foot walk board, the roof anchor points, and thus the vertical support posts 125, are spaced approximately twenty (20) feet apart. The spacing between adjacent roof anchor points may be increased or decreased to accommodate walk boards of various lengths.

OSHA requires that adjacent safety rail posts, in this case the vertical safety rail post 127, be no greater than eight feet apart. Therefore, over a 20 to 24 foot span, one would anticipate 4 such safety rail posts 127 to be employed in the above example. Note that each of the safety rail posts 127 would have a pair of angled brackets 155 welded thereto to provide rigidity and stability over the entire length of the walk board.

Aluminum tubes 141 are attached horizontally at 21" and 42" along vertical safety rail post 127 to form an OSHA compliant railing between adjacent safety rail posts. The aluminum tubes, usually 2" tubular aluminum or equivalent material, are affixed to the vertical safety rail post 127 by stainless steel U-bolts 145 with wing nuts at the ends.

Figure 6:
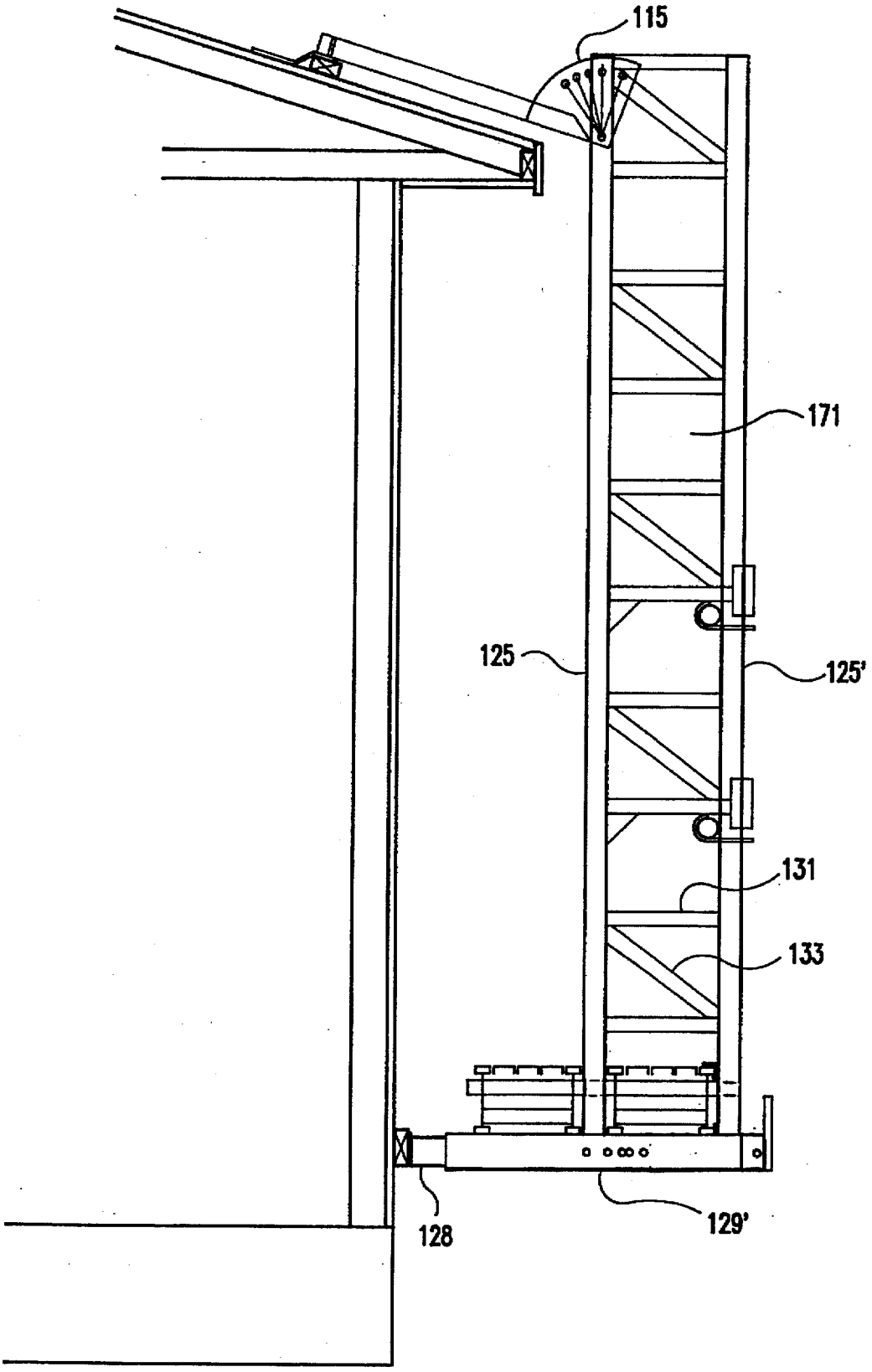
FIG. 6 illustrates a side view of an alternate embodiment of the hanging scaffold system of FIG. 4 employing a ladder assembly.

An additional embodiment of the hanging scaffold system is illustrated in FIG. 6, which incorporates a ladder 171 by providing a second vertical support post 125'; similar in construction to vertical support post 125, and welded or bolted at one end to an elongated base 129'. Note also that the base portion 129' is modified and extended from that shown in FIG. 4 to provide additional strength to support the ladder 171 and provide an attachment point for the second vertical support post 125'. The second vertical support post is parallel to and spaced approximately one foot from vertical support post 125. Horizontal braces 131 secured to vertical support posts 125 and 125' serve as ladder rungs in this embodiment, supported by diagonal braces 133. Additional walk boards may be placed on the ladder rungs 131 to provide working platforms at various heights on a single hanging scaffold system.

The working platform system described above thus utilizes a series of stability and rigidity enhancing features to provide a safe, secure platform hanging off the eave of a roof system. It allows the craftsman to work on the eave, fascia, soffit, and freeze board systems without the scaffolding system interfering with the work of applying the trim boards. The craftsman is also able to work faster and with more confidence without the fear of falling off the roof or scaffold.

In addition, the system may be 95% assembled on the ground and then lifted into position with the use of a spreader bar and forklift or crane. It takes approximately 1–2 man hours to erect the hanging scaffold, and about the same amount of time to take it down. This is a tremendous time savings compared to the typical scaffold systems requiring 4.5 man days to assemble and three man days to disassemble.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

Having thus described my invention, what I claim as new and desire to secure by Letters Patent is as follows:

1. In a roof having a truss structure composed of spaced apart joists running perpendicular to a roof edge and a sheet overlay on top of said joists defining small gaps between courses of sheets forming the overlay, a roof tie-off anchoring system, comprising:

a base support member contacting said overlay and having first and second ends;

a thin, flat joist securement assembly pivotally connected with a hinge means about a horizontal axis to said first end of said base support member, said thin, flat joist securement assembly lockingly engaging and disengaging a respective underlying joist through said small gaps, said securement assembly comprising a thin, flat J-hook having a main body portion, a bottom portion and a upstanding tip portion, said bottom portion in locking engagement with an underside of said joist and said main body portion and said upstanding tip portion in contact with respective sides of said joist, thereby providing three-sided engagement of the J-hook to the joist; and a means for attaching a rope or cable extending from said second end of said base support member to provide a tie-off attachment point.

2. A roof tie-off anchoring system as in claim 1, wherein said means for attaching is a substantially flat member having a hole therein to allow a rope or cable system to be attached thereto.

3. A roof tie-off anchoring system as in claim 2, wherein said means for attaching is inclined from the roof overlay.

4. A roof tie-off anchoring system as in claim 3, wherein said means for attaching is inclined at a substantially vertical angle.

5. A roof tie-off anchoring system as in claim 1, wherein said means for attaching is non-continuous loop member to detachably secure the rope or cable.

6. In a roof having a truss structure composed of spaced apart joists running perpendicular to a roof edge and a sheet overlay on top of said joists defining small gaps between courses of sheets forming the overlay, a hanging scaffold and anchoring system, comprising:

a base support member contacting said overlay and having first and second ends;

a thin, flat joist securement assembly pivotally connected with a hinge means about a horizontal axis to said first end of said base support member, said thin, flat joist securement assembly lockingly engaging and disengaging a respective underlying joist through said small gaps, said securement assembly comprising a thin, flat J-hook having a main body portion, a bottom portion and a upstanding tip portion, said bottom portion in locking engagement with an underside of said joist and said main body portion and said upstanding tip portion in contact with respective sides of said joist, thereby providing three-sided engagement of the J-hook to the joist; and means for attaching a hanging scaffold system extending from said second end of said base support member.

7. The hanging scaffold and anchoring system of claim 6, wherein the means for attaching comprises a flat, elongated strap fixed at a first end to the second end of the base support member.

8. The hanging scaffold and anchoring system of claim 7, wherein a second end of said means for attaching includes a receiving plate having steel studs extending therefrom.

9. The hanging scaffold and anchoring system of claim 8, wherein the receiving plate contains an angled portion extending apart from the roof overlay.

10. The hanging scaffold and anchoring system of claim 9, further comprising a female member having stud holes provided at one end so as to mate with the respective studs of the receiving plate.

11. The hanging scaffold and anchoring system of claim 10, further including an adjustable elbow joint at a second end of said female member, said elbow joint having a first pivoting connection aligned with a first aperture on a first vertical support post and a second adjustable connection aligned with a second aperture on said first vertical support post.

12. The hanging scaffold and anchoring system of claim 11, wherein the second adjustable connection includes a plurality of angle positions that may be selected to align with the second aperture on the first vertical support post.

13. The hanging scaffold and anchoring system of claim 12, further including a platform base connected to said first vertical support post.

14. The hanging scaffold and anchoring system of claim 13, further including an inner sleeve in sliding contact within the platform base to move said first vertical support post laterally, said inner sleeve capable of being fixed by pin connections mating the platform base and inner sleeve.

15. The hanging scaffold and anchoring system of claim 14, further comprising a plurality of walk boards in contact with said base platform.

16. The hanging scaffold and anchoring system of claim 15, further including a vertical safety rail post parallel to and spaced apart from said first vertical support post, said safety rail post having two spaced apart L-shaped angled brackets affixed to a bottom end portion, and said walk boards residing between said L-shaped angle brackets on said vertical safety rail post.

17. The hanging scaffold and anchoring system of claim 16, further including means for securing the walk boards in clamping contact with said first vertical support post.

18. The hanging scaffold and anchoring system of claim 17, wherein said means for securing is a rod attached at one end to said vertical safety rail post, said rod being passed through said walk boards, and said rod being securely fastened at the other end.

19. The hanging scaffold and anchoring system of claim 12, further including a second vertical support post spaced apart and parallel to said first vertical support post, said first and second vertical support posts having horizontal and angled brackets therebetween, defining a ladder or support surface for additional walk boards.

20. The hanging scaffold and anchoring system of claim 19, further including an extended platform base connected to said first and second vertical support posts.

21. In a roof having a truss structure composed of spaced apart joists running perpendicular to a roof edge and a sheet overlay on top of said joists defining small gaps between courses of sheets forming the overlay, an anchoring system incorporating a roof tie-off and hanging scaffold system, comprising:

a base support member contacting said overlay and having first and second ends;

a thin, flat joist securement assembly pivotally connected with a hinge means about a horizontal axis to said first end of said base support member, said thin, flat joist securement assembly lockingly engaging and disengaging a respective underlying joist through said small gaps, said securement assembly comprising a thin, flat J-hook having a main body portion, a bottom portion and a upstanding tip portion, said bottom portion in locking engagement with an underside of said joist and said main body portion and said upstanding tip portion in contact with respective sides of said joist, thereby providing three-sided engagement of the J-hook to the joist;

a means for attaching a rope or cable extending from said second end of said base support member to provide a tie-off attachment point; and a means for attaching a hanging scaffold system extending from said second end of said base support member.

22. In a roof having a truss structure composed of spaced apart joists running perpendicular to a roof edge and a sheet overlay on top of said joists defining small gaps between courses of sheets forming the overlay, a hanging scaffold and anchoring system, comprising:

a base support member contacting said overlay and having first and second ends;

a joist securement assembly pivotally connected about a horizontal axis to said first end of said base support member for lockingly engaging and disengaging said securement assembly through said small gaps to a respective underlying joist, said securement assembly comprising a J-hook having a main body portion, a bottom portion and a upstanding tip portion, said bottom portion in locking engagement with an underside of said joist and said main body portion and said upstanding tip portion in contact with respective sides of said joist, thereby providing three-sided engagement of the J-hook to the joist;

means for attaching a hanging scaffold system extending from said second end of said base support member, the means for attaching comprising a flat, elongated strap fixed at a first end to the second end of the base support member;

a second end of said means for attaching includes a receiving plate having steel studs extending therefrom, wherein the receiving plate contains an angled portion extending apart from the roof overlay;

a female member having stud holes provided at one end so as to mate with the respective studs of the receiving plate;

an adjustable elbow joint at a second end of the female member, said elbow joint having a first pivoting connection aligned with a first aperture on a first vertical support post and a second adjustable connection aligned with a second aperture on said first vertical support post, said second adjustable connection includes a plurality of angle positions that may be selected to align with the second aperture on the first vertical support post;

a platform base connected to said first vertical support post;

an inner sleeve in sliding contact within the platform base to move said first vertical support post laterally, said inner sleeve capable of being fixed by pin connections mating the platform base and inner sleeve;

a plurality of walk boards in contact with said base platform;

a vertical safety rail post parallel to and spaced apart from said first vertical support post, said safety rail post having two spaced apart L-shaped angled brackets affixed to a bottom end portion, and said walk boards residing between said L-shaped angle brackets on said vertical safety rail post; and means for securing the walk boards in clamping contact with said first vertical support post, wherein said means for securing is a rod attached at one end to said vertical safety rail post, said rod being passed through said walk boards, and said rod being securely fastened at the other end.

* * * * *